US008292755B2

(12) United States Patent
Wakabayashi et al.

(10) Patent No.: US 8,292,755 B2
(45) Date of Patent: Oct. 23, 2012

(54) GOLF CLUB SHAFT AND GOLF CLUB

(75) Inventors: Masaki Wakabayashi, Minamisouma (JP); Yoshihito Kogawa, Minamisouma (JP)

(73) Assignee: Fujikura Rubber Ltd., Tokyo (JP)

( * ) Notice: Subject to any disclaimer, the term of this patent is extended or adjusted under 35 U.S.C. 154(b) by 280 days.

(21) Appl. No.: 12/600,056

(22) PCT Filed: Feb. 24, 2009

(86) PCT No.: PCT/JP2009/053237
§ 371 (c)(1),
(2), (4) Date: Nov. 13, 2009

(87) PCT Pub. No.: WO2009/113382
PCT Pub. Date: Sep. 17, 2009

(65) Prior Publication Data

US 2010/0234124 A1 Sep. 16, 2010

(30) Foreign Application Priority Data

Mar. 14, 2008 (JP) ..... 2008-65056

(51) Int. Cl.
*A63B 53/10* (2006.01)

(52) U.S. Cl. ..... 473/319

(58) Field of Classification Search ..... 473/316–323
See application file for complete search history.

(56) References Cited

U.S. PATENT DOCUMENTS 5,093,162 A * 3/1992 Fenton et al. ..... 428/34.5
5,427,373 A * 6/1995 Kusumoto ..... 473/319
6,126,557 A * 10/2000 Preece et al. ..... 473/320
6,354,957 B1 * 3/2002 Saito ..... 473/289
6,705,954 B2 * 3/2004 Takiguchi et al. ..... 473/319

(Continued)

FOREIGN PATENT DOCUMENTS

JP 09-131422 5/1997

(Continued)

OTHER PUBLICATIONS

English Computer Translation of 9-131422 dated May 20, 1997, Matsumoto A.*

(Continued)

*Primary Examiner* — Stephen L. Blau
(74) *Attorney, Agent, or Firm* — McCormick, Paulding & Huber LLP

(57) ABSTRACT

A golf club shaft is provided in which the flexural rigidity of the distal end portion can be improved with no change in flexural rigidity on the proximal end while the dispersion in the values of the flexural rigidity in the circumferential direction can be reduced without the use of a distal-end reinforcing layer that causes discontinuous points in the lengthwise direction in flexural rigidity. A golf club shaft is provided which satisfies the following conditions: that the golf club shaft includes at least three rectangular carbon prepregs as full-length layers, that all the rectangular carbon prepregs are each composed of a 0-degree layer, the long fiber direction of which is coincident with the longitudinal direction of the golf club shaft, that all the rectangular carbon prepregs are configured such that the amount of overlapping of each rectangular carbon prepreg is zero on the large-diameter proximal end portion of the gold club shaft and increasingly overlaps at positions increasingly toward the distal end of the golf club shaft, and that wind start positions of the rectangular carbon prepregs are different from one another.

5 Claims, 10 Drawing Sheets

U.S. PATENT DOCUMENTS

| | | | | |
|---|---|---|---|---|
| 6,872,151 | B2 * | 3/2005 | Oyama | 473/319 |
| 6,875,127 | B2 * | 4/2005 | Hasegawa | 473/319 |
| 7,077,761 | B2 * | 7/2006 | Nishio | 473/314 |
| 7,318,780 | B2 * | 1/2008 | Oyama | 473/319 |
| 7,361,098 | B2 * | 4/2008 | Oyama | 473/319 |
| 7,404,771 | B2 * | 7/2008 | Kumamoto | 473/319 |
| 7,727,083 | B2 * | 6/2010 | Takeuchi | 473/319 |
| 2002/0123392 | A1 * | 9/2002 | Yamada | 473/319 |
| 2006/0058111 | A1 * | 3/2006 | Kumamoto | 473/319 |
| 2006/0073905 | A1 * | 4/2006 | Oyama | 473/316 |
| 2007/0072697 | A1 * | 3/2007 | Matsumoto et al. | 473/316 |
| 2007/0238546 | A1 * | 10/2007 | Takeuchi | 473/319 |
| 2008/0026868 | A1 * | 1/2008 | Takeuchi | 473/319 |
| 2009/0305811 | A1 * | 12/2009 | Matsumoto et al. | 473/319 |

FOREIGN PATENT DOCUMENTS

| | | |
|---|---|---|
| JP | 10-329247 | 12/1998 |
| JP | 11-188125 | 7/1999 |
| JP | 2005-270515 | 10/2005 |

OTHER PUBLICATIONS

International Search Report for PCT/JP2009/053237.

* cited by examiner

| Number of turns at distal end | Shape | Number of turns at proximal end |
|---|---|---|
| 2 | 11 | 2 |
| 2 | 12 | 2 |
| 2.1 | 21 | 1 |
| 2 | 22 | 1 |
| 2 | 23 | 1 |
| – | 17 | 0 |

| Number of turns at distal end | Shape | Number of turns at proximal end |
|---|---|---|
| 2 | 11 | 2 |
| 2 | 12 | 2 |
| 2.1 | 21 | 1 |
| 2 | 22 | 1 |
| 2 | 23 | 1 |
| 2 | 24 | 1 |
| — | 17 | 0 |

| | 0° Direction | 45° Direction | 90° Direction | Dispersion |
|---|---|---|---|---|
| Position | EI | EI | EI | EI |
| (mm) | (N · m²) | (N · m²) | (N · m²) | (N · m²) |
| 180 | 22.76 | 22.30 | 22.13 | 0.63 |
| 220 | 24.14 | 23.81 | 23.62 | 0.52 |
| 270 | 25.92 | 25.62 | 25.55 | 0.38 |
| 320 | 27.91 | 27.64 | 27.82 | 0.26 |
| 370 | 29.91 | 29.91 | 29.80 | 0.10 |
| 420 | 31.86 | 32.22 | 31.98 | 0.35 |
| 470 | 34.63 | 34.36 | 34.10 | 0.54 |
| 520 | 37.13 | 36.66 | 36.21 | 0.92 |
| 570 | 39.47 | 38.94 | 38.43 | 1.04 |
| 620 | 41.73 | 41.14 | 40.38 | 1.35 |
| 670 | 44.26 | 43.59 | 42.54 | 1.72 |
| 720 | 46.86 | 45.64 | 45.40 | 1.46 |
| 770 | 48.41 | 47.37 | 46.86 | 1.55 |
| 820 | 50.65 | 50.07 | 50.07 | 0.58 |
| 870 | 53.11 | 52.16 | 51.85 | 1.26 |
| 920 | 55.46 | 54.09 | 54.43 | 1.37 |
| 970 | 55.81 | 55.81 | 55.81 | 0.00 |

| Position (mm) | 0° Direction EI (N · m²) | 45° Direction EI (N · m²) | 90° Direction EI (N · m²) | Dispersion EI (N · m²) |
|---|---|---|---|---|
| 180 | 25.04 | 24.75 | 25.04 | 0.28 |
| 220 | 26.88 | 26.80 | 26.96 | 0.16 |
| 270 | 29.11 | 29.21 | 29.31 | 0.19 |
| 320 | 31.41 | 31.29 | 31.75 | 0.45 |
| 370 | 33.83 | 33.70 | 33.96 | 0.26 |
| 420 | 36.06 | 36.21 | 36.06 | 0.15 |
| 470 | 38.77 | 38.60 | 38.43 | 0.34 |
| 520 | 41.14 | 40.76 | 40.76 | 0.38 |
| 570 | 43.59 | 43.17 | 43.17 | 0.43 |
| 620 | 45.64 | 45.64 | 45.64 | 0.00 |
| 670 | 48.15 | 48.15 | 48.15 | 0.00 |
| 720 | 50.95 | 50.65 | 50.65 | 0.29 |
| 770 | 53.43 | 52.79 | 53.76 | 0.97 |
| 820 | 56.17 | 56.53 | 55.81 | 0.72 |
| 870 | 58.42 | 58.81 | 58.42 | 0.39 |
| 920 | 60.02 | 60.43 | 60.43 | 0.41 |
| 970 | 62.59 | 63.04 | 62.59 | 0.45 |

| Number of turns at distal end | Shape | Number of turns at proximal end |
|---|---|---|
| 2 | 11 | 2 |
| 2 | 12 | 2 |
| 1 | 13 | 1 |
| 1 | 14 | 1 |
| 1 | 15 | 1 |
| 2 | 16 | 2−0 |
| — | 17 | 0 |

| Number of turns at distal end | Shape | Number of turns at proximal end |
|---|---|---|
| 2 | 11 | 2 |
| 2 | 12 | 2 |
| 1 | 18 | 1 |
| 1 | 19 | 1 |
| 2 | 22 | 1 |
| – | 17 | 0 |

| Position (mm) | 0° Direction EI (N · m²) | 45° Direction EI (N · m²) | 90° Direction EI (N · m²) | Dispersion EI (N · m²) |
|---|---|---|---|---|
| 180 | 20.86 | 20.14 | 19.17 | 1.69 |
| 220 | 22.24 | 21.17 | 20.05 | 2.19 |
| 270 | 24.27 | 22.70 | 21.91 | 2.37 |
| 320 | 26.63 | 24.75 | 24.01 | 2.63 |
| 370 | 28.73 | 27.30 | 26.47 | 2.26 |
| 420 | 31.52 | 29.91 | 29.11 | 2.41 |
| 470 | 34.50 | 33.32 | 32.22 | 2.28 |
| 520 | 37.77 | 35.91 | 35.05 | 2.72 |
| 570 | 40.95 | 38.60 | 37.77 | 3.18 |
| 620 | 44.48 | 42.13 | 40.57 | 3.91 |
| 670 | 47.62 | 44.48 | 43.59 | 4.03 |
| 720 | 50.95 | 48.15 | 46.36 | 4.58 |
| 770 | 54.43 | 51.24 | 48.95 | 5.47 |
| 820 | 57.65 | 54.09 | 52.79 | 4.86 |
| 870 | 60.43 | 56.53 | 56.53 | 3.90 |
| 920 | 63.04 | 60.02 | 59.21 | 3.83 |
| 970 | 65.39 | 62.59 | 62.59 | 2.80 |

| Number of turns at distal end | Shape | Number of turns at proximal end |
|---|---|---|
| 2 | 11 | 2 |
| 2 | 12 | 2 |
| 1 | 19 | 1 |
| 2 | 22 | 1 |
| 2 | 23 | 1 |
| – | 17 | 0 |

| Position (mm) | 0° Direction EI (N · m²) | 45° Direction EI (N · m²) | 90° Direction EI (N · m²) | Dispersion EI (N · m²) |
|---|---|---|---|---|
| 180 | 23.94 | 24.01 | 24.21 | 0.26 |
| 220 | 25.62 | 25.40 | 25.33 | 0.30 |
| 270 | 27.73 | 27.64 | 27.38 | 0.35 |
| 320 | 30.11 | 30.22 | 29.31 | 0.91 |
| 370 | 32.70 | 32.70 | 31.52 | 1.18 |
| 420 | 35.19 | 34.36 | 33.83 | 1.36 |
| 470 | 37.93 | 36.97 | 36.51 | 1.42 |
| 520 | 40.57 | 39.47 | 38.77 | 1.80 |
| 570 | 43.38 | 42.33 | 41.53 | 1.85 |
| 620 | 46.36 | 45.64 | 44.26 | 2.11 |
| 670 | 49.51 | 48.41 | 46.86 | 2.65 |
| 720 | 52.16 | 50.95 | 50.07 | 2.09 |
| 770 | 54.77 | 53.11 | 52.79 | 1.98 |
| 820 | 57.65 | 56.53 | 55.46 | 2.19 |
| 870 | 61.28 | 58.42 | 58.42 | 2.86 |
| 920 | 63.50 | 62.15 | 60.85 | 2.65 |
| 970 | 65.88 | 64.43 | 63.96 | 1.92 |

GOLF CLUB SHAFT AND GOLF CLUB

CROSS REFERENCE TO RELATED APPLICATIONS

This application claims the priority of Japanese patent application No. 2008-65056, filed on Mar. 14, 2008 and PCT Application No. PCT/JP2009/053237, filed on Feb. 24, 2009, the disclosures of which are incorporated herein by reference in their entirety.

TECHNICAL FIELD

The present invention relates to a golf club shaft formed by winding prepregs (sheets) made of thermosetting resin and curing the same thermally, and also relates to a golf club.

BACKGROUND OF THE INVENTION

Prepregs are known as sheet materials made of carbon fibers impregnated with uncured thermosetting resin. In the field of golf club shafts, a plurality of prepregs are wound on a mandrel in the shape of a tapered shaft and thermally cured to be formed into a tapered golf club shaft.

Conventionally, there are usually two types of prepregs: full-length layer and distal-end reinforcing layer. The full-length layer is usually formed into a trapezoidal shape so that the number of turns becomes the same across the full length when wound on a taper-shaped mandrel. The distal-end reinforcing layer is a layer wound only on the distal end portion because the strength (bending rigidity, EI) of the distal end portion becomes insufficient if only trapezoidal prepregs are wound thereon.

FIG. 6 shows a configuration example of a golf club shaft composed of such conventional full-length layers and a distal-end reinforcing layer. This conventional example is made using two trapezoidal bias layers (45-degree layers; the long fiber direction is angled at 45-degrees relative to the shaft axis direction) 11 and 12, each of which is wound two turns (i.e., the number of turns is four in total), three 0-degree trapezoidal layers (the long fiber direction thereof is parallel to the axis of the golf club shaft) 13, 14 and 15, each of which is wound one turn, and a distal-end reinforcing layer 16 composed of a 0-degree layer, in that order from lower layer. The directions of biases (long fibers) of the trapezoidal bias layers 11 and 12 are orthogonal to each other. The distal-end reinforcing layer 16 is a layer for reinforcing the distal end portion and is wound only on the distal end portion. Aside from the distal end reinforcing layer 16, a triangular prepreg 17 composed of a 0-degree layer, which is used to make the distal end portion of the golf club shaft into a straight portion corresponding to the hosel diameter of the golf club shaft, is wound on the distal end portion (on the distal-end reinforcing layer 16).

The trapezoidal layers 11 through 15, the distal-end reinforcing layer 16 and the triangular prepreg 17 which are wound on a mandrel 10 are heated to cure the uncured thermosetting resin of these layers, thereby forming a golf club shaft. Various types of carbon fibers which can be used as carbon fibers of the trapezoidal layers 11 through 15, the distal-end reinforcing layer 16 and the triangular prepreg 17, and various types of thermosetting resins which can be used as thermosetting resin with which such carbon fibers are impregnated are known in the art.

Patent Document 1: Japanese Unexamined Patent Publication H09-131422

Patent Document 2: Japanese Unexamined Patent Publication 2000-51413

PROBLEM TO BE SOLVED BY THE INVENTION

Line C shown in FIG. 5 is a graph showing a measurement result of a flexural rigidity distribution of this conventional golf club shaft in the lengthwise (axial) direction. Since the flexural rigidity varies stepwise (discontinuously) at the distal-end reinforcing layer 16, this golf club shaft, which includes the total of five full-length trapezoidal layers 11 through 15, the distal-end reinforcing layer 16 and the triangular prepreg 17, does not bend flexibly and smoothly and the head speed does not increase when the golf club is swung, which makes it impossible to give the user a desirable sense of use.

In addition, it has been proposed to make a golf club shaft contain rectangular carbon prepregs; however, if rectangular carbon prepregs are simply used, flexural rigidities at different positions in the circumferential direction disperse, so that the performance as a golf club, to which a club head is attached, does not become stable.

In view of the above described problems concerning conventional golf club shafts, an object of the present invention is to obtain a golf club shaft in which the flexural rigidity of the distal end portion can be improved with no change in flexural rigidity on the proximal end while the dispersion in the values of the flexural rigidity in the circumferential direction can be reduced without the use of a distal-end reinforcing layer that causes discontinuous points in the lengthwise direction in flexural rigidity.

SUMMARY OF THE INVENTION

As a means for solving the problem the present invention is characterized by a golf club shaft formed by winding prepregs made of uncured thermosetting resin into a tapered shape and curing the prepregs thermally, the golf club shaft including at least three rectangular carbon prepregs as full-length layers, wherein all of the rectangular carbon prepregs are composed of a 0-degree layer, a long fiber direction of which is coincident with a longitudinal direction of the golf club shaft, all of the rectangular carbon prepregs are configured such that an amount of overlapping of each the rectangular carbon prepreg is zero at a large-diameter proximal end portion of the gold club shaft and increasingly overlaps at positions increasingly toward a distal end of the golf club shaft, and wind start positions of the rectangular carbon prepregs are different from one another.

The most desirable number of the rectangular carbon prepregs is four.

It is desirable for the wind start positions of at least three rectangular carbon prepregs to be clocked.

It is generally the case that the golf club shaft according to the present invention is configured such that a triangular carbon prepreg is added to a distal end portion of the golf club shaft to make the distal end portion into a straight shape for fixing the distal end portion to a club head.

The golf club according to the present invention is a golf club having the above-described golf club shaft to which a golf club head and a grip are fixed.

EFFECT OF THE INVENTION

In a golf club shaft according to the present invention, with no occurrence of discontinuous points in the lengthwise direction in flexural rigidity, the flexural rigidity of the distal end portion can be improved, the flexural rigidity of the full length can be improved, and also the dispersion in the values of the flexural rigidity in the circumferential direction can be reduced.

DESCRIPTION OF THE NUMERALS

10 Mandrel
11,12 Trapezoidal bias layers
16 Distal-end reinforcing layer
17 Triangular carbon prepreg
21,22,23,24 Rectangular carbon prepregs (0-degree layers)

DESCRIPTION OF THE PREFERRED EMBODIMENTS

Figure 1:
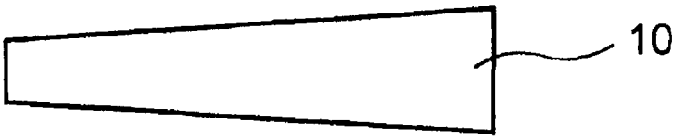
FIG. 1 shows plan views of carbon prepregs of a first embodiment of a golf club shaft according to the present invention, showing the shapes and the configurations of the carbon prepregs.
Figure 6:
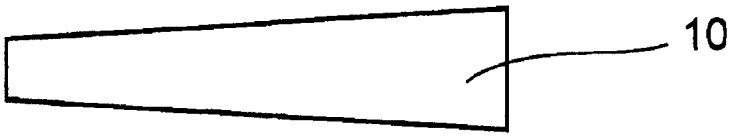
Fig.6 Prior Art
FIG. 6 shows plan views similar to those of FIG. 1, showing an example of a conventional golf club shaft.

FIG. 1 shows a first embodiment of a golf club shaft according to the present invention, illustrating the configuration of carbon prepregs thereof so as to correspond to FIG. 6. The elements (carbon fibers and thermosetting resin) except the shapes of the carbon prepregs are identical to those of the conventional example, and trapezoidal bias layers 11 and 12 are identical to those of the conventional example shown in FIG. 6. In the present embodiment, three rectangular carbon prepregs 21, 22 and 23 constituting full-length layers each composed of a 0-degree layer (each of which is wound one turn) are used as carbon prepregs which are wound on the trapezoidal carbon prepregs 11 and 12. Although the triangular carbon prepreg 17 is used in a similar manner to the conventional example, the distal-end reinforcing layer 16 in the conventional example is not used (is unnecessary). Namely, all the carbon prepregs except the triangular carbon prepreg 17, which is used to form the distal end portion into a straight shape matching with a golf club head, are full-length layers.

Portions of the rectangular carbon prepregs 21 through 23 on the proximal end (large-diameter portion side) are wound one turn over the entire circumference of the mandrel 10 (with opposite ends of each rectangular carbon prepreg being butt-joined to each other), and remaining portions of the rectangular carbon prepregs 21 through 23 are wound on the mandrel 10 so that the amount of overlapping increases at positions increasingly toward the distal end portion (small-diameter portion). Although the amount of overlapping (overlap angle) of each of the rectangular carbon prepregs 21 through 23 at the distal end varies depending on the length of the mandrel 10 and the taper angle thereof, there are two layers (turns) at the distal end in the first embodiment shown in FIG. 1. In addition, the wind start positions of the three rectangular carbon prepregs 21 through 23 are predetermined to be arranged (clocked) at equi-angular intervals as closely as possible.

Figure 5:
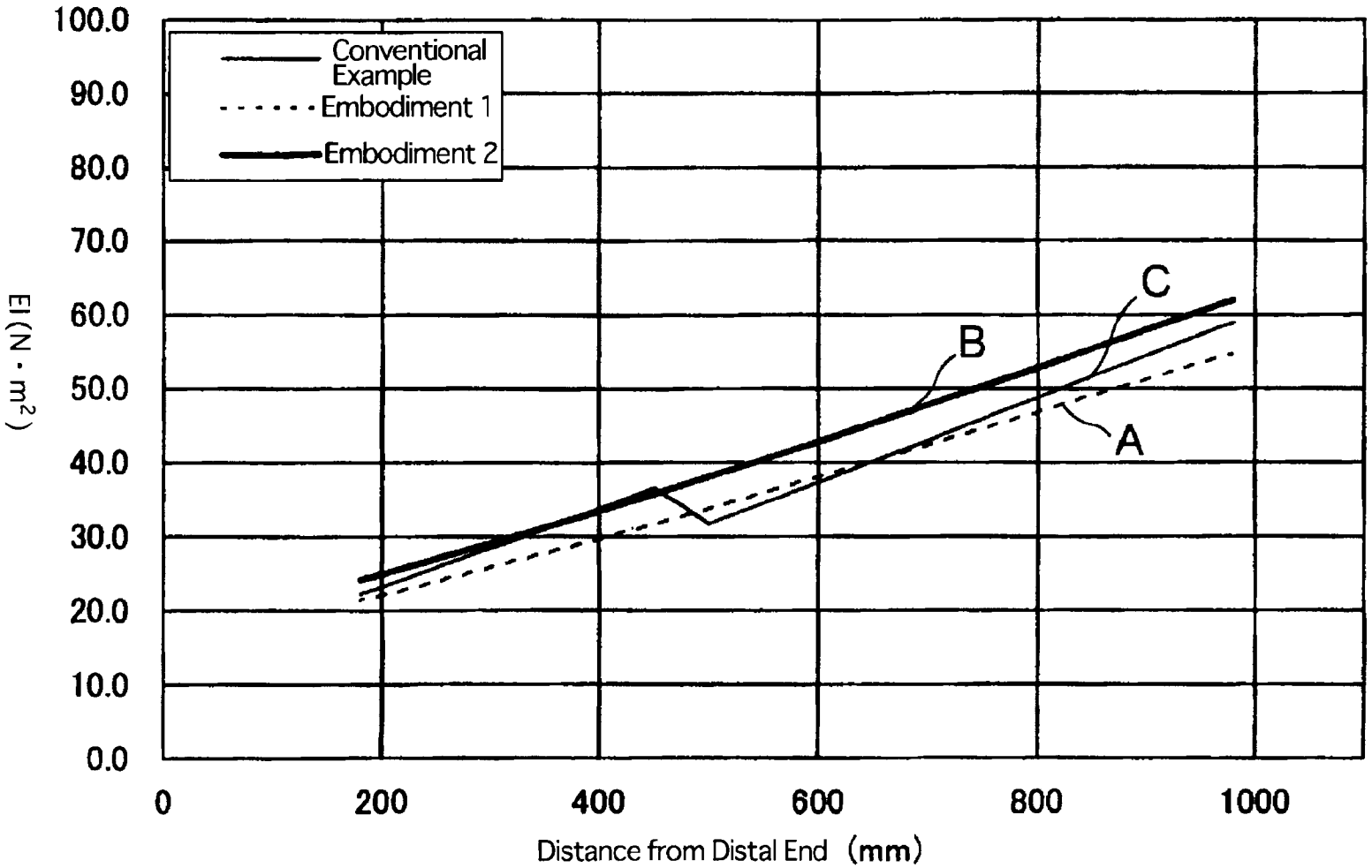
FIG. 5 is a graphical diagraph showing a measurement result of a flexural rigidity distribution of each of the first embodiment of the golf club shaft, the second embodiment of the golf club shaft, and a conventional golf club shaft shown in FIG. 6 in the lengthwise direction.

Line A shown in FIG. 5 is a graph showing a measurement result of a flexural rigidity distribution of the golf club shaft, in the lengthwise direction, which is formed by winding each carbon prepreg having the configuration shown in FIG. 1 on the mandrel 10 and thermally curing the same. As clearly understood from this graph, in the present embodiment of the golf club shaft, the flexural rigidity smoothly changes from the distal end portion (except the portion of the triangular carbon prepreg 17) to the proximal end portion. This smoothens the bending of the golf club shaft when the golf club is swung and also increases the head speed, which makes it possible to give the user an ideal sense of use.

Figure 2:
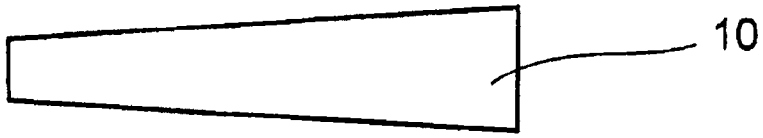
FIG. 2 shows plan views similar to those of FIG. 1, showing a second embodiment of the golf club shaft.

FIG. 2 shows a second embodiment of the golf club shaft according to the present invention, in which four rectangular carbon prepregs 21, 22, 23 and 24, each composed of a 0-degree layer (each of which is wound one turn), are wound on the trapezoidal carbon prepregs 11 and 12. The remaining configuration is identical to that shown in FIG. 1. Line B shown in FIG. 5 shows a flexural rigidity distribution of this embodiment of the golf club shaft in the lengthwise direction. Similar to Line A of the first embodiment shown in the same graph, the flexural rigidity smoothly changes from the distal end portion (except the portion of the triangular carbon prepreg 17) to the proximal end portion; moreover, the overall flexural rigidity is high because the number of rectangular carbon prepregs each composed of a 0-degree layer is increased by one.

Figure 3:
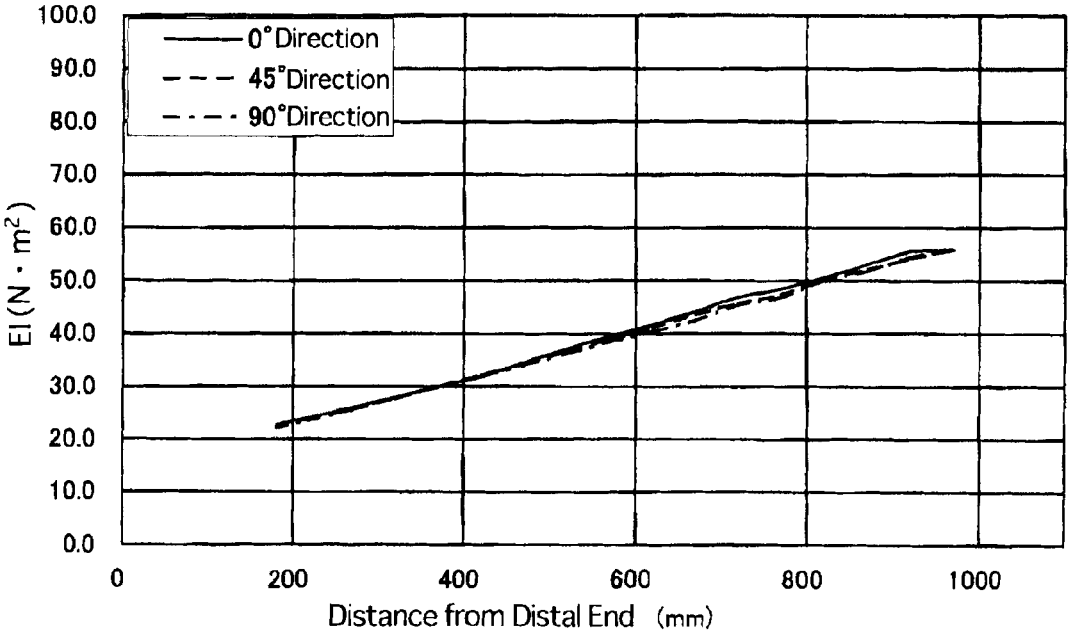
FIG. 3 shows graphical diagrams showing a measurement result of flexural rigidities of the first embodiment of the golf club shaft at different circumferential positions.
Figure 4:
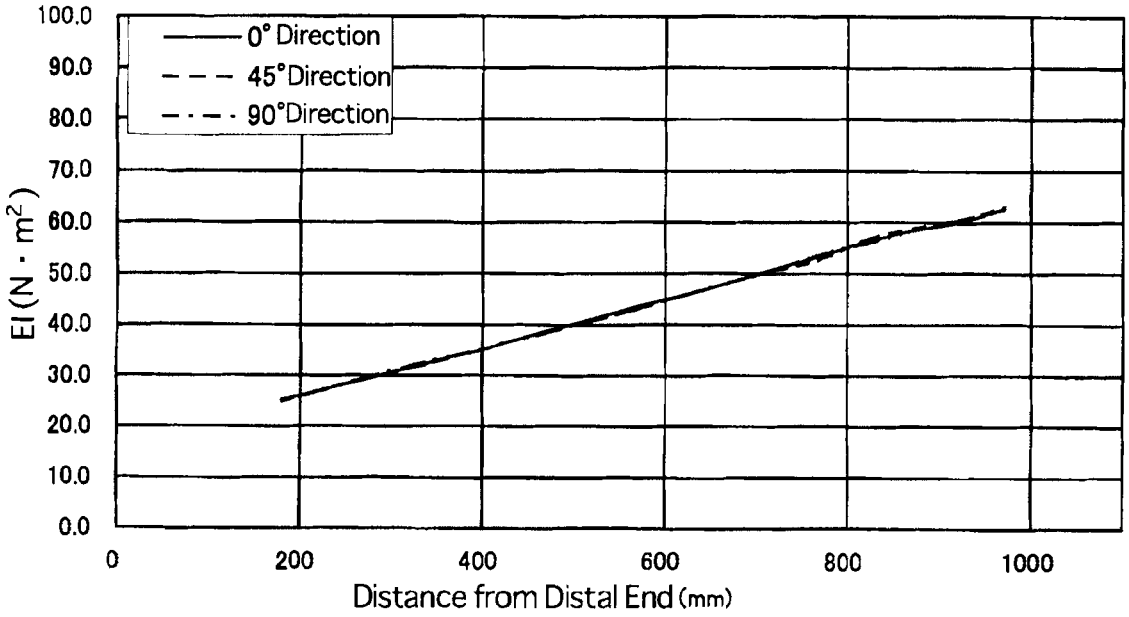
FIG. 4 shows graphical diagrams showing a measurement result of flexural rigidities of the second embodiment of the golf club shaft at different circumferential positions.

FIGS. 3 and 4 are graphs each showing a measurement results of the dispersion in the values of the flexural rigidity of the first and second embodiments of the golf club shafts in the circumferential direction, respectively. The dispersion in the values of the flexural rigidity in the circumferential direction refers to the dispersion that occurs when the values of the flexural rigidity are measured by changing the rotational phase of a manufactured golf club shaft. In these embodiments, flexural rigidity is measured at different circumferential positions (three positions: 0, 45 and 90 degrees). From the graphs shown in FIGS. 3 and 4, in the first and second embodiments of the golf club shafts, it is confirmed that almost no dispersion occurs in the flexural rigidity in the circumferential direction. In this connection, in each graph shown in FIGS. 3, 4, 8 and 10, the numerical values have been included since the difference between the three line graphs is visually unclear.

As shown in the above described embodiments, it is essential that the number of rectangular carbon prepregs to be used in each of the above described embodiments is at least three and that all the rectangular carbon prepregs be 0-degree layers and be full-length layers. By satisfying these conditions, the rigidity of the distal end portion can be increased smoothly without changing the rigidity of the proximal end portion.

Figure 7:
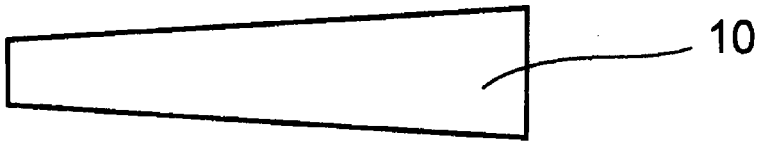
FIG. 7 shows plan views similar to those of FIG. 1, showing a first comparative example of a golf club shaft.
Figure 8:
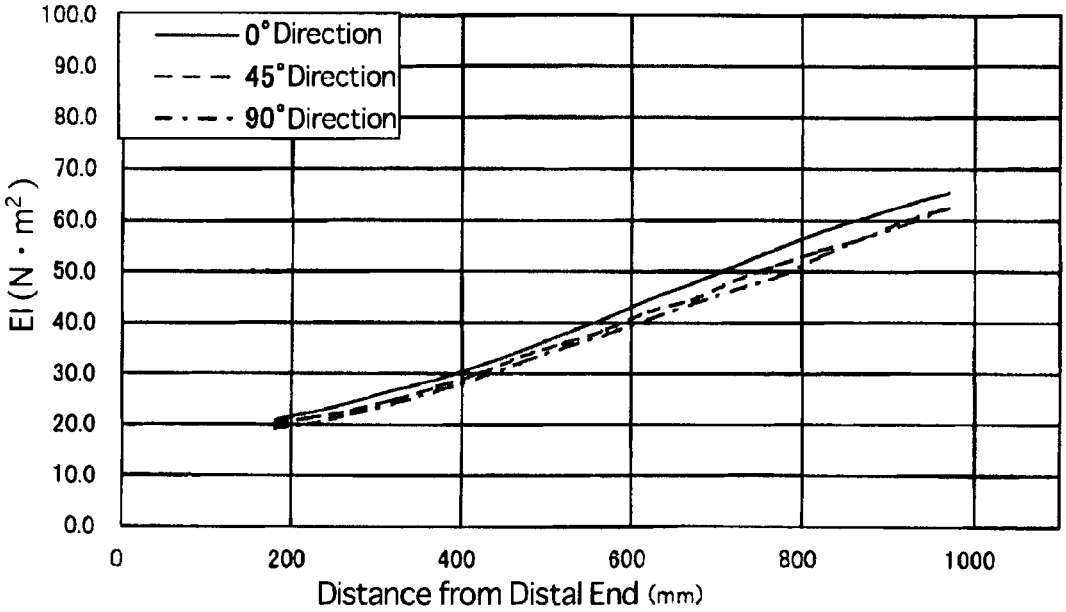
FIG. 8 shows graphical diagrams showing a measurement result of flexural rigidities of the golf club shaft shown in FIG. 7 at different circumferential positions.

Next, the necessity of at least three rectangular carbon prepregs to prevent the flexural rigidity in the circumferential direction from dispersing will be hereinafter discussed with reference to comparative examples. FIG. 7 is a comparative example to be compared with the embodiment shown in FIG. 1, in which the rectangular carbon prepregs 21 and 22 shown in FIG. 1 are replaced by trapezoidal carbon prepregs 18 and 19. FIG. 8 shows a graphical diagram illustrating a measurement result of flexural rigidities of this golf club shaft at different circumferential positions (three positions: 0, 45 and 90 degrees).

Figure 9:
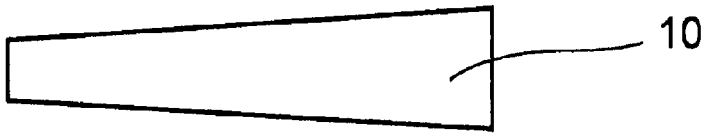
FIG. 9 shows plan views similar to those of FIG. 1, showing a second comparative example of a golf club shaft.
Figure 10:
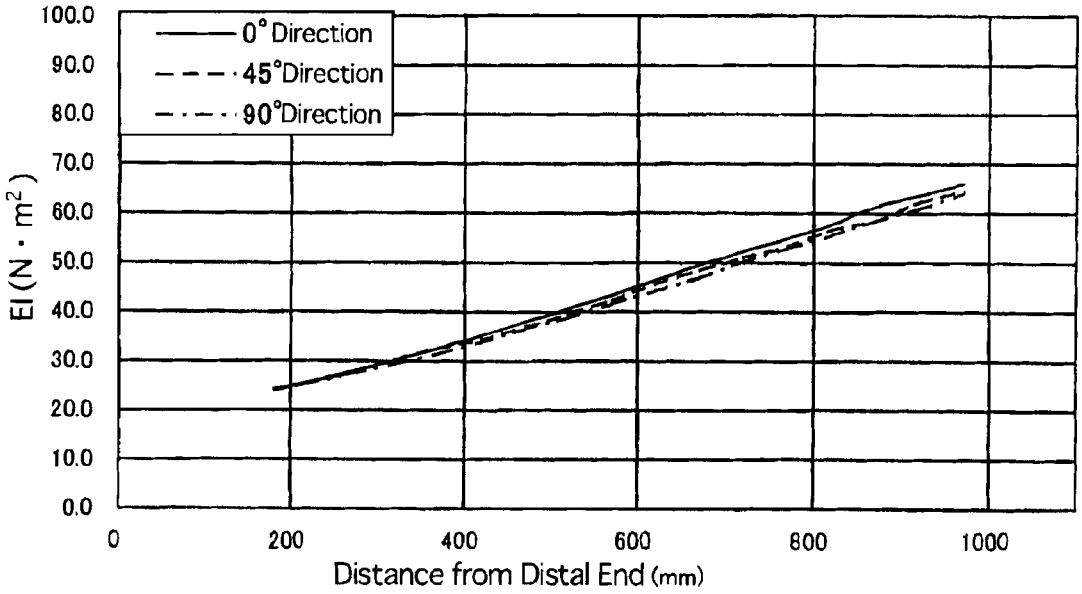
FIG. 10 shows graphical diagrams showing a measurement result of flexural rigidities of the golf club shaft shown in FIG. 9 at different circumferential positions.

In addition, similar to FIG. 7, FIG. 9 is a comparative example to be compared with the embodiment shown in FIG. 1, in which the rectangular carbon prepreg 21 shown in FIG. 1 is replaced by a trapezoidal carbon prepreg 19. FIG. 10 are graphical diagrams showing a measurement result of flexural rigidities of this golf club shaft at different circumferential positions (three position: 0, 45 and 90 degrees).

As clearly understood from these graphical diagrams, in the case where the number of rectangular carbon prepregs is one or two, dispersion in the flexural rigidity in the circumferential direction is confirmed.

In the present embodiments, the distal-end reinforcing layer 16 that is an essential element of the conventional golf club shaft is unnecessary. Accordingly, the flexural rigidity of distal end portion can be increased with no need to use the distal-end reinforcing layer 16, which is advantageous with respect to parts management also in manufacturing process.

Although the two bias layers 11 and 12 (each of which is wound two turns) are illustrated as full-length trapezoidal layers under the rectangular carbon prepregs 21 through 24 in the above described embodiments, the number of turns of the bias layers can be any number. In addition, regarding the bias layers, the number of turns on the distal end side and the number of turns on the proximal end do not have to be the same. Additionally, the fiber direction and the material thereof are also optional.

The invention claimed is:

1. A golf club shaft formed by winding prepregs made of uncured thermosetting resin into a tapered shape and curing said prepregs thermally, said golf club shaft comprising:

at least three rectangular carbon prepregs as full-length layers, wherein all of said rectangular carbon prepregs are composed of a 0-degree layer, a long fiber direction of which is coincident with a longitudinal direction of said golf club shaft, wherein all of said rectangular carbon prepregs are configured such that an amount of overlapping of each said rectangular carbon prepreg progressively increases from one turn with zero overlap at a large-diameter proximal end portion of said golf club shaft to a full turn overlap at a distal end of said golf club shaft, and wherein wind start positions of said rectangular carbon prepregs are different from one another.

2. The golf club shaft according to claim 1, wherein the number of said rectangular carbon prepregs is four.

3. The golf club shaft according to claim 1, wherein said wind start positions of said at least three rectangular carbon prepregs are clocked.

4. The golf club shaft according to claim 1, wherein a triangular carbon prepreg is added to a distal end portion of said golf club shaft to make said distal end portion into a straight shape for fixing said distal end portion to a club head.

5. A golf club having said golf club shaft according to claim 1 to which a golf club head and a grip are fixed.

* * * * *